US005902412A

United States Patent [19]

Taylor

[11] Patent Number: 5,902,412

[45] Date of Patent: May 11, 1999

[54] METHOD OF CLEANING/COATING A SUBSTRATE

[76] Inventor: Timothy L. Taylor, 1335 Arabella, #4, New Orleans, La. 70115

[21] Appl. No.: 08/688,729

[22] Filed: Jul. 31, 1996

Related U.S. Application Data

[63] Continuation-in-part of application No. 08/419,658, Apr. 12, 1995, Pat. No. 5,654,129, and application No. 08/202,592, Feb. 28, 1994, abandoned.

[51] Int. Cl.[6] ..... B08B 7/04

[52] U.S. Cl. ..... 134/12; 134/40; 134/64 P

[58] Field of Search ..... 134/64 P, 40, 134/12

[56] References Cited

U.S. PATENT DOCUMENTS

| | | | |
|---|---|---|---|
| 3,615,814 | 10/1971 | Ott et al. | 134/64 |
| 3,635,762 | 1/1972 | Ott et al. | 15/100 |
| 3,737,941 | 6/1973 | Miller et al. | 15/100 |
| 3,882,568 | 5/1975 | Hill | 15/100 |
| 4,086,179 | 4/1978 | Schneider | 252/171 |
| 5,250,208 | 10/1993 | Merchant et al. | 134/40 |

*Primary Examiner*—Kriellion S. Morgan
*Attorney, Agent, or Firm*—C. Emmett Pugh; Pugh/Associates

[57] ABSTRACT

Mixtures comprised of the compounds trans-1,2-dichloroethylene and/or cis-1,2-dichloroethylene and perchloroethylene are disclosed; as is a method for cleaning a solid substrate which comprises treating the substrate with said mixtures. A method for precision cleaning is disclosed, comprising the steps of showering the contaminated surfaces with said mixtures and then rinsing said surfaces with said mixtures that have been cleaned by distillation in-system. A method for dissolving and reconstituting polymers, waxes and oils by use of said mixtures or by use of mixtures consisting essentially of trans-1,2-dichloroethylene or cis-1,2-dichloroethylene is also disclosed; as is a method for delivering polymers, waxes, oils paints, pesticides, insecticides and fungicides to a surface by use of said mixtures or by use of mixtures consisting essentially of trans-1,2-dichloroethylene or cis-1,2-dichloroethylene.

10 Claims, 1 Drawing Sheet

METHOD OF CLEANING/COATING A SUBSTRATE

REFERENCE TO RELATED APPLICATIONS

This application is a continuation-in-part of U.S. patent application Ser. No. 08/419,658, filed Apr. 12, 1995 and entitled "METHOD FOR CLEANING ACETATE-BASED PHOTOGRAPHIC FILM WITH TRANS-DICHLOROETHYLENE" issued as U.S. Pat. No. 5,654,129 on Aug. 5, 1997, and its prior parent application, U.S. patent application Ser. No. 08/202,592 filed Feb. 28, 1994, and entitled "METHOD FOR CLEANING ACETATE-BASED PHOTOGRAPHIC FILM WITH TRANS-DICHLOROETHYLENE," abandoned in favor of the '658 CIP application.

TECHNICAL FIELD

The present invention relates to chlorinated hydrocarbons and their uses, and more particularly to mixtures comprising trans-1,2-dichloroethylene and perchloroethylene and their multiple solvent applications.

BACKGROUND ART

It is well known in the art that chlorinated solvents are useful as cleaning agents for solid substrates such as photographic film, electronic and mechanical parts, molds for casting plastics, surfaces being prepared for painting, fabrics, and various other surfaces in need of degreasing. It is also well known to persons skilled in the requisite art that chlorinated solvents are useful for dissolving materials such as polymers, waxes, oils, paints, the active ingredients in pesticides, insecticides, and fungicides, and for removing these substances from, or delivering these substances to a surface. Frequently, these substances were put into solution with a chlorinated solvent and an aerosol propellant (e.g. butane, propane, nitrogen, fluorocarbons, and carbon dioxide). The resulting solution was then suitable for various aerosol applications including cleaning and coating a substrate with the active ingredient.

One of the most common solvents used to date for such purposes is the compound 1,1,1-trichloroethane. 1,1,1-Trichloroethane has a relatively low boiling point, is non-flammable, and has a high solvency power. However, 1,1,1-trichloroethane and certain other chlorinated hydrocarbons have been theoretically linked to the depletion of the earth's protective ozone layer, and subsequently banned from commercial use in the United States. It is therefore desirable to produce a solvent, capable of multiple applications which has a relatively low boiling point, a high solvency power, is non-flammable, and most importantly, environmentally safe in that it does not deplete the ozone.

Some prior art solutions to this problem have involved using azeotropes and quasi-azeotropes based upon halohydrocarbons containing fluorine for some solvent applications where 1,1,1-trichloroethane had been formerly used. However, there are certain distinct disadvantages to using such azeotropes and quasi-azeotropes.

An azeotrope is a solution of two or more liquids, the composition of which does not change upon distillation. According to Anton, et al., (U.S. Pat. No. 5,221,361), "it is not possible to predict the formation of azeotropes and this obviously complicates the search for new azeotropic systems." Yet Anton mentions that "there is a constant effort in the art to discover new azeotropes, or azeotrope-like systems which have desirable solvency characteristics and particularly a greater range of solvency power." Such azeotropes and quasi-azeotropes are difficult and expensive to discover and produce. Furthermore, a fixed boiling point and solvency power may limit the usefulness of an azeotrope or quasi-azeotrope.

A need exists, therefore, for affordable, versatile, non-ozone depleting alternatives to traditional chlorinated solvents or to expensive azeotropic or quasi-azeotropic compositions designed to replace these chlorinated solvents.

A list of prior patents which may be of interest is provided below:

| Patent No. | Inventor | Issue Date |
|---|---|---|
| 5,250,208 | Merchant, et al. | 5 OCT 1993 |
| 4,086,179 | Schneider | 25 APR 1978 |
| 3,882,568 | Hill | 13 MAY 1975 |
| 3,737,941 | Miller, et al. | 12 JUN 1973 |
| 3,635,762 | Ott, et al. | 18 JAN 1972 |
| 3,615,814 | Ott, et al. | 25 NOV 1969 |

Hill discloses a method for cleaning acetate-based photographic film using a lint-free material that has been moistened with a cleaning solvent such as methyl chloroform. Hill does not mention the use of trans-dichloroethylene as the cleaning solvent.

Schneider teaches the use of cleaning solvents containing non-azeotropic mixture including 1,1,1-trichloroethane.

Merchant, et al. is directed to ternary azeotropic compositions which possibly include trans-dichloroethylene.

GENERAL SUMMARY DISCUSSION OF INVENTION

The present invention relates to non-azeotropic mixtures of the chlorinated hydrocarbon trans-1,2-dichloroethylene with perchloroethylene (i.e. tetrachloroethylene). There are provided in accordance with this invention methods for cleaning solid substrates with these non-azeotropic mixtures. There are also provided in accordance with this invention methods for dissolving and removing polymers, waxes and oils from a surface by use of this solvent mixture. There are also provided in accordance with this invention methods for depositing polymers, waxes oils and other lubricants, pesticides, insecticides and fungicides onto a surface.

In addition, cis-1,2-dichloroethylene may be used in combination with the perchloroethylene instead of or with the trans-1,2-dichloroethylene to achieve similar results. The present invention pertains to the interchangeable and combination use of these two chlorinated hydrocarbons with perchloroethylene to provide a non-azeotropic mixture with very desirable solvency characteristics.

It is thus an object of the invention to provide a solvent capable of replacing 1,1,1-trichloroethane in its many applications that is environmentally safe for the earth's ozone layer.

It is a further object of the invention to provide a solvent with a relatively low boiling point, high solvency power, non-flammability, and no ozone depletion potential.

It is a still further object of the invention to provide a non-azeotropic solvent capable of cost-effective manufacture with high solvency characteristics capable of a wide range of solvent applications.

And it is yet a still further object of the invention to provide a non-azeotropic solvent using the chlorinated hydrocarbons trans-1,2-dichloroethylene and/or cis-1,2-dichloroethylene in combination with perchloroethylene.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
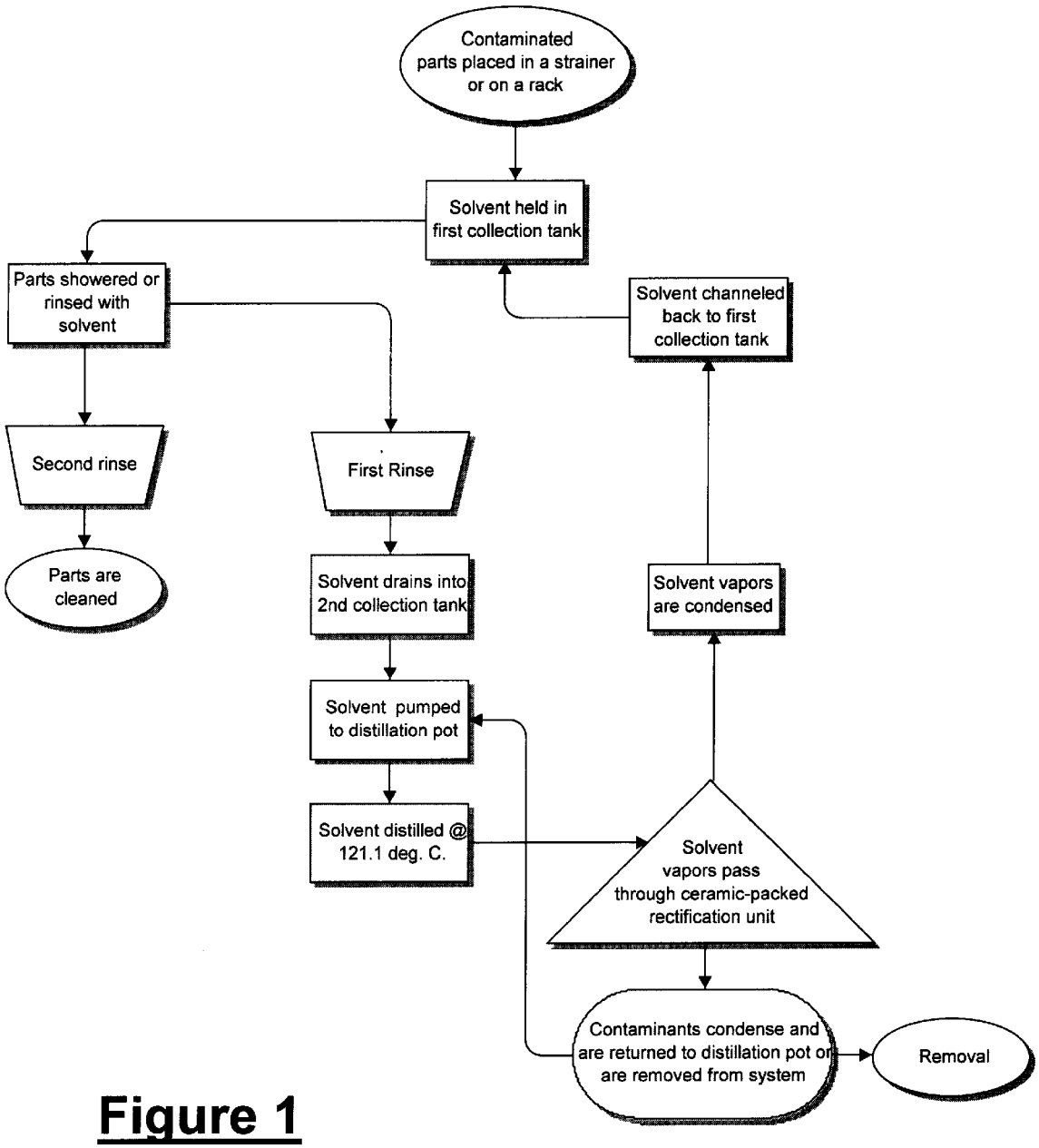
FIG. 1 is a flow chart illustrating a method for cleaning of various parts using the solvent blends disclosed herein.

Trans-1,2-dichloroethylene can be blended with effective amounts of perchloroethylene to form non-azeotropic compositions useful in a variety of solvent applications. These blends can be easily adjusted to suit the specific demands of a particular solvent application. For instance, more trans-1,2-dichloroethylene can be added if the blend needs a greater solvency power or a lower boiling point. More perchloroethylene can be added if the blend needs to be rendered less flammable (or altogether inflammable), or if a lesser solvency power or a higher boiling point is desired. The same principles apply when using cis-1,2-dichloroethylene with perchloroethylene. In order to illustrate the various blends of trans-1,2-dichloroethylene and perchloroethylene that are suitable for various applications, several tests were performed using variable volume percentages of both chemicals in solution and the results were compared to the prior art cleaning solution of 1,1,1-trichloroethane. See Tables 1–5 below.

It was discovered that perchloroethylene may serve as an unusually effective carrier for the other two more powerful solvents. Perchloroethylene has a tendency to spread out into a thin film, and because it is readily miscible with the more powerful trans-1,2-dichloroethylene or cis-1,2-dichloroethylene it efficiently carries these more powerful solvents onto contaminated substrates where they accomplish most of the solvent work. The blend then drips from the substrate, carrying dissolved contaminants away with it. Any solvent remaining on the surface dries quickly, leaving no residue.

These blends were found to be effective at removing from solid substrates a variety of contaminants such as greases, oils, waxes, polymers or solder fluxes. Examples of these solid substrates might be metals, glass, photographic films, stone or stone-like materials such as concrete, wood, natural fibers used in clothing, and certain plastics and synthetic fibers that are not readily dissolved by trans-1,2-dichloroethylene, cis-1,2-dichloroethylene or perchloroethylene.

In various tests, these contaminants were effectively removed from a number of the above-mentioned substrates. Greases and oils at room temperature were applied to substrates, and then removed by emersion and/or buffing and/or showering with various blends of trans-1,2-dichloroethylene and perchloroethylene. Certain polymers, waxes and solder fluxes were applied to surfaces after having been liquified (melted) by heat. These contaminants then solidified upon cooling, and were removed from their respective substrates by application of various blends of the afore-mentioned solvents.

In every case, there were distinct advantages to using the blends of the solvents, rather than any of the solvents alone. Perchloroethylene was generally too weak to accomplish any solvent cleaning in an efficient amount of time. Trans-1,2-dichloroethylene or cis-1,2-dichloroethylene alone showed a tendency to dissolve the contaminants and then evaporate so quickly that the contaminant often had no time to drain away from the substrate. This was particularly the case when trans-1,2-dichloroethylene was used to dissolve certain polymers from substrates. Yet, when blended with perchloroethylene, both of the two more powerful solvents held contaminants in solution long enough to wash or wipe them from the substrate. In this way, effective cleaning of surfaces was accomplished.

For example, a variety of substrates were contaminated with ordinary 10W-40 motor oil by applying the oil to the substrate with a cotton cloth. Metal, both steel and aluminum, glass, and polyvinylchloride (PVC) substrates were contaminated. The contaminated substrate was submersed in a sealed container of solvent/solvent blend and then the container was gently agitated for thirty seconds, the parts were then removed and inspected for signs of visual contamination. The results are given below in the following Tables 1–7.

TABLE 1

DEGREASING OF METAL SUBSTRATES (STEEL AND ALUMINUM)

| 1,1,1-TRICHLOROETHANE | TRANS-DICHLOROETHYLENE | PERCHLOROETHYLENE | CONTAMINATION REMOVED |
|---|---|---|---|
| 100% | | | MOST |
| | 100% | | ALL |
| | 95% | 5% | ALL |
| | 80% | 20% | ALL |
| | 50% | 50% | MOST |
| | 20% | 80% | MOST |
| | 5% | 95% | SOME |

TABLE 2

DEGREASING GLASS SUBSTRATES

| 1,1,1-TRICHLOROETHANE | TRANS-DICHLOROETHYLENE | PERCHLOROETHYLENE | CONTAMINATION REMOVED |
|---|---|---|---|
| 100% | | | MOST |
| | 100% | | ALL |
| | 95% | 5% | ALL |
| | 80% | 20% | ALL |
| | 50% | 50% | MOST |
| | 20% | 80% | SOME |
| | 5% | 95% | SOME |

TABLE 3

DEGREASING PVC SUBSTRATES

| 1,1,1-TRICHLOROETHANE | TRANS-DICHLOROETHYLENE | PERCHLOROETHYLENE | CONTAMINATION REMOVED |
|---|---|---|---|
| 100% | | | MOST |
| | 100% | | ALL |
| | 95% | 5% | ALL |
| | 80% | 20% | ALL |
| | 50% | 50% | MOST |

TABLE 3-continued

| DEGREASING PVC SUBSTRATES | | | |
|---|---|---|---|
| 1,1,1-TRICHLOR-OETHANE | TRANS-DICHL-OROETHYLENE | PERCHLORO-ETHYLENE | CONTAMI-NATION REMOVED |
| | 20% | 80% | MOST |
| | 5% | 95% | SOME |

These tests indicate that blends of trans-dichloroethylene and perchloroethylene make excellent degreasers. The blends managed to remove the relatively heavy 10W-40 motor oil and therefore it is anticipated that lighter weight oils, such as machine oils, or other light-weight lubricants such as silicone or teflon, will also be readily removed from metal, glass, and PVC surfaces by the afore-mentioned blends. The results of the tests have not been rated on any particular scale, other than indicating that all of the contaminate was removed as far as was visible and to the touch, because the various blends appear to perform with equal degrees of success with the exception of the eighty (80%) percent and ninety-five (95%) percent perchloroethylene blends which were only slightly less effective.

One added benefit to these blends is that they may be easily adjusted to accomplish a certain solvent task. For example, plastics are generally more difficult to dissolve than oils, so when plastic residues need to be removed from a substrate, as in a mold used for casting plastic items, a more powerful solvent blend may be devised by increasing the percentage of trans-1,2-dichloroethylene, or cis-1,2-dichloroethylene in the blend. Should it be imperative that the solvent is non-flammable, a blend can be devised by using effectively higher amounts of perchloroethylene, which has been long known to extinguish flames. In addition, the less expensive perchloroethylene makes a blend more cost-effective.

Furthermore, these blends of trans-dichloroethylene or cis-dichloroethylene with perchloroethylene represent an improvement in applications where pure perchloroethylene has been used, especially in degreasing applications such as brake systems and electronic parts.

Polycarbonate is a type of polymer commonly used to cast casings for appliances such as radios, computers and telephones, cassette tapes, cassette or compact disc cases, as well as ordinary disposable items such as ball-point pens and razors. Items made from polycarbonates are generally cast in a mold. After a period of time it is necessary to clean the surface of these molds.

Cleaning tests were conducted to simulate this cleaning by melting approximately one gram of polycarbonate onto a stainless steel surface and allowing it to cool, and then immersing the steel in the various solvent or solvent blends for up to thirty minutes to see how much contamination was removed. At the end of the emersion period, the steel was vigorously agitated to wash off the glutinous polycarbonate residue. The results are indicated in the following table.

TABLE 4

| CLEANING POLYCARBONATE RESIDUES | | | |
|---|---|---|---|
| 1,1,1-TRICHLOR-OETHANE | TRANS-DICHL-OROETHYLENE | PERCHLORO-ETHYLENE | CONTAMI-NATION REMOVED |
| 100% | | | SOME |
| | 100% | | ALL |
| | 95% | 5% | ALL |
| | 80% | 20% | ALL |
| | 50% | 50% | MOST |
| | 20% | 80% | SOME |
| | 5% | 95% | SOME |

These tests indicate that trans-dichloroethylene or blends of trans-dichloroethylene and perchloroethylene dissolve polycarbonate very effectively where 1,1,1-trichloroethane was not as effective. It was also noted that the higher the concentration of trans-dichloroethylene the quicker the polycarbonate was dissolved. For example, pure trans-dichloroethylene dissolves polycarbonate in approximately fifteen minutes.

In the cleaning of simple substrates and intricate parts such as electronic circuit boards contaminated with solder flux, vapor degreasing has been the preferred method. In order to insure that no contaminants in the solvent are deposited onto the parts intended for cleaning, the liquid solvent is boiled, or distilled, and its pure vapors then condense on the colder circuit board suspended above the distillation pot. In this way, only clean solvent actually comes into contact with the contaminated surface. This is especially necessary in the final rinsing stage of the vapor decreasing operation.

A blend of trans-1,2-dichloroethylene or cis-1,2-dichloroethylene with perchloroethylene would not be suitable for a vapor degreasing operation because the components of the blend, with their different boiling points, would fractionate upon evaporation and then condense upon the contaminated surfaces in undesirable proportions. However, a simple cleaning system may be devised wherein contaminated parts are first showered with the solvent blend and then rinsed with some of the blend that has been freshly distilled in-system. Such a cleaning system is diagramatically depicted in FIG. 1 and is an improvement over the prior art in that it utilizes the less expensive and more versatile transdichloroethylene and perchloroethylene blend as solvent as opposed to a more expensive, azeotropic blend. Such a system could effectively replace vapor degreasing systems particularly in that a showering system will remove more contaminants than a vapor system.

In the first step, contaminated parts are placed into a mesh container or onto a rack and then showered with solvent from a first collection tank. The solvent blend drains from the parts and into a second collection tank where it is pumped into a separate distillation pot.

In the distillation pot, the contaminated solvent is then distilled; of course, the components fractionate as they reach their separate boiling points inside the distillation pot. For example, with a blend of trans-1,2-dichloroethylene and perchloroethylene, the trans-1,2-dichloroethylene would boil at approximately forty-eight (48° C.) degrees centigrade, while the temperature would need to be raised at least another seventy three and one-tenth (73.1° C.) degrees centigrade in order to vaporize the perchloroethylene at approximately one hundred and twenty-one and one-tenth (121.1° C.) degrees centigrade. Nevertheless, these solvent vapors are almost entirely free of contaminants.

The solvent vapors then pass from the distillation pot, through a ceramic-packed rectification unit, where any possible contaminants born in the vapors condense and are removed from the system. Then the vapors pass into a condenser, where they are liquified in turn and then pumped into the first collection tank, wherein they are essentially remixed in the originally intended proportions of the solvent blend.

This freshly distilled solvent is used as a final rinse for the parts. In this way, simple and highly effective precision-cleaning operations may be accomplished with non-azeotropic blends of trans-1,2-dichloroethylene and perchloroethylene, or cis-1,2-dichloroethylene and perchloroethylene.

Circuit boards, commonly used in electronic appliances such as televisions or computers are often contaminated with solder flux in the assembly process. Solder flux is a grease-like substance that is either applied to the surface of the board before soldering, or is contained in the core of the solder itself, in order to help the solder retain heat and spread onto a surface. This sticky flux residue must then be removed from the surface of the circuit board. Various techniques may be employed to clean these multi-faceted surfaces with a solvent, among them vapor degreasing as described above, spraying, or brushing.

A test was performed in which circuit board material was contaminated with solder flux following a simple soldering operation and then cleaned by spraying and then brushing solvents or solvent blends onto the surfaces. Solvent was allowed to drip off the board. Surfaces were then examined for efficacy of cleaning. The following results were observed.

TABLE 5

CLEANING PRINTED CIRCUIT BOARDS

| 1,1,1-TRICHLOROETHANE | TRANS-DICHLOROETHYLENE | PERCHLOROETHYLENE | CONTAMINATION REMOVED |
|---|---|---|---|
| 100% | | | SOME |
| | 100% | | MOST |
| | 95% | 5% | MOST |
| | 80% | 20% | MOST |
| | 50% | 50% | SOME |
| | 20% | 80% | SOME |
| | 5% | 95% | LITTLE |

The tests show that while flux is difficult to remove from a circuit board without substantial brushing of the surface, it is still possible to remove most residue, thereby rendering the board useful, with all the above solvents, or solvent blends, except the five (5%) percent trans-dichloroethylene blend. Pure trans-dichloroethylene was the most effective flux removing agent, but it is anticipated that this solvent will attack certain components on the circuit boards, such as the polycarbonate casings of certain switches, or the synthetic rubber insulation of capacitors. The fifty (50%) trans-dichloroethylene blend appears to imitate 1,1,1 more closely than any of the other blends tested. With the appropriate technique, blends of trans-dichloroethylene and perchloroethylene can be effectively used to clean electronic circuit boards.

The cleaning of electronic components such as integrated circuits or silicon chips provides a further application for trans-dichloroethylene and perchloroethylene solvent blend even though they may not be contaminated with the relatively heavy, sticky solder flux. For example, it is necessary to clean silicon chips after manufacturing simply to remove any possible contamination, as these delicate parts must be absolutely clean. Silicon chips are composed of no material that trans-dichloroethylene or perchloroethylene will attack and the solvent blend will therefore serve as an excellent cleaner for them and various other electronic components as well.

Further, trans-dichloroethylene either alone or blended with another suitable miscible liquid such as perchloroethylene, can work effectively to clean various types of photographic films including polyester base film. Photographic films are composed of an emulsion layer, containing photosensitive silver-halide particles, spread upon a base material. The base material may be either an acetate or polyester base. A polyester base is useful since it is far more durable and scratch-resistant than an acetate base film which is commonly used for film negatives.

Some common contaminants on film are dust, lint and fingerprints. Trans-dichloroethylene, either pure or blended with perchloroethylene works effectively to clean polyester base film.

In accordance with this invention a method for cleaning photographic film with transdichloroethylene is provided. The method includes the step of immersing the film in a bath of solvent comprising a non-azeotropic mixture including trans-dichloroethylene. The preferred embodiment of the solvent also includes perchloroethylene. A drying step may be included where a jet of warm air helps to evaporate the solvent form the film surface.

An alternate method of cleaning the film includes the step of buffing the film with a lint-free material that has been moistened with the non-azeotropic mixture including trans-dichloroethylene and preferably perchloroethylene.

The proportions of the blend of trans-dichloroethylene and perchloroethylene may be adjusted to change the cleaning qualities of the blend the same as for the other above mentioned substrates. The two solvents were highly compatible as a blend for several reasons: 1) Trans-dichloroethylene has a high solvency power which accomplishes most of the cleaning work, 2) perchloroethylene's spreading action distributed trans-dichloroethylene evenly over the film surface, 3) trans-dichloroethylene, with a tolerance level of two hundred (200 ppm) helps reduce the toxicity of perchloroethylene which has a tolerance level of twenty five (25 ppm), 4) perchloroethylene has a relatively low vapor pressure, thus rendering the blend less volatile, and 5) perchloroethylene renders the blend less flammable, if not altogether inflammable.

A common cleaning machine for commercial motion-picture films is the model CF3000 MK VI as manufactured by Lipsner-Smith which includes subjecting the film to ultrasonic cavitation in a bath of a cleaning agent followed by rinsing said film with a filtered rinse for said cleaning agent. Currently these machines use 1,1,1-trichloroethane which, as discussed above, is no longer viable due to the environmental risks associated with it. While trans-dichloroethylene is slightly more flammable than 1,1,1-trichloroethane, these machines could be easily and inexpensively modified using a nitrogen pad so that a fire within the cleaning compartment would be virtually impossible. Thus these machines are rendered useful for many years despite the unavailability of 1,1,1-trichloroethane.

A variety of tests were performed to rate the cleaning ability of solvents and blends on contaminated pieces of 35 mm polyester-base film. A scaled score was used to indicate the particular solvent or blends cleaning efficacy and drying efficacy. The scale range was from one (1) to six(6) with six(6) being the most effective and one(1) being the least effective.

The method involved in the test included contaminating a strip of 35 mm polyester-base film with finger prints and dust. Then the film was emersed in a sealed container of the various solvents and solvent blends. The container was vigorously shaken for fifteen seconds and then the film was removed and dried using a low speed jet of warm air. To accelerate drying, cleaning agents comprising perchloroethylene were also dried with a high speed jet of air, approximately two to three times stronger than the low speed jet and are indicated in the table as the second number in the drying time column. Test results are indicated in Table 6 where chemical percentages are by volume and times are in seconds.

TABLE 6

EMERSION CLEANING OF PHOTOGRAPHIC FILM

| tri-chloro ethane | trans-dichlor-oethylene | per-chloro-ethylene | % dust re-moved | % finger-print removed | rating | drying time |
|---|---|---|---|---|---|---|
| 100% | | | 100% | 90% | 4.5 | 4 |
| | 100% | | 100% | 95% | 6 | 2 |
| | | 100% | 100% | 75% | 1 | 30/12 |
| | 5% | 95% | 100% | 75% | 5.5 | 25/10 |
| | 20% | 80% | 100% | 80%–85% | 3 | 15/6 |
| | 50% | 50% | 100% | 90% | 4 | 10/3 |
| | 80% | 20% | 100% | 95% | 4.5 | 8/3 |
| | 95% | 5% | 100% | 95% | 5.5 | 4 |

A second test was performed on the polyester base film where the film was contaminated with fingerprints over an area exactly four perforations long and across the width of the film. Then a cotton-tipped swab that had been moistened with each of the solvents or solvent blends was swiped across the surface of the film. Cleaning efficacy was observed. Then the entire area of contamination was buffed with a new cotton-tipped swab that had been dipped only once in solvent. Repeated buffing was employed to remove all possible contamination. The test results are indicated below in Table 7 where percentages of solvents are given by volume, drying time is given in seconds, and scores are assigned on a scale of one to five with five being a top score based upon cleaning efficiency.

TABLE 7

SWAB CLEANING OF PHOTOGRAPHIC FILM

| trichloro ethane | trans-dichloro-ethylene | per-chloro-ethylene | # of passes to clean | rating | drying time of pass |
|---|---|---|---|---|---|
| 100% | | | 13 | 3 | 1 |
| | 100% | | 8 | 5 | 0 |
| | | 100% | 16 | 1 | 2–3 |
| | 20% | 80% | 15 | 2 | 1 |
| | 50% | 50% | 10 | 4 | 1 |
| | 80% | 20% | 8 | 5 | 1 |

Not only was a difference noted in how many passes were required to completely clean the film but there was a significant difference in the effectiveness of a single pass for the various solvents and blends. The first pass of the swab dipped in either the transdichloroethyelene alone and the eighty (80%) percent transdichloroethylene blend was very clean and sharp. The fifty (50%) percent blend of trans-dichloroethylene and the 1,1,1-trichloroethane was fairly clean with just a little smear around the edges. In contrast, the perchloroethylene and twenty (20%) percent trans-dichloroethylene blend remained very smeared after the first pass of the swab.

Finally, it was discovered that trans-1,2-dichloroethylene by itself, cis-1,2-dichloroethylene by itself, or either of these compounds blended with perchloroethylene, can be used to deliberately dissolve polymers, waxes, oils, and paints. These substances may then be reconstituted on any number of surfaces for the purpose of providing a coating.

First, the soluble substance is dissolved in the solvent. Then this liquid is applied to a substrate either by dipping, brushing, spraying, including aerosol spraying, the latter being the most effective. Then the solvent is made to evaporate from the substrate by the application of heat, or by the natural evaporation tendencies of the solvent. The polymers, waxes, oils or paints are then left behind upon the substrate in an even, thorough coating. It is anticipated that a transdichloroethylene and perchloroethylene blend will work very effectively in aerosol lubricants like "WD-40"™, "Liquid Wrench"™, or various other teflon or silicon sprays.

One possible application would be to use any of these solvents, or blends thereof, in white liquid correcting fluid such as "Wite-Out"™. Another possible application would be to use these solvent blends to dissolve the active ingredients (i.e. poisons) in pesticides, insecticides or fungicides.

While tests were conducted on pure blends of trans-dichloroethylene and perchloroethylene containing no other ingredients, in practice it is anticipated that other miscible ingredients may be added to the mixture for various purposes. For example, certain ingredients may be added that will render trans-dichloroethylene or the blends non-flammable. Or in film-cleaning application, an anti-static agent may be added to inhibit static charge build-up, as is currently done with commercial application of 1,1,1-trichloroethane. Finally, other solvents or alcohol may be added to the mixture, either to alter the qualities of the mixture slightly or simply to reduce the price.

Therefore, it is important to keep in mind that the qualities for the blends discerned in the foregoing tests are attributable to the ratio of trans-dichloroethylene to perchloroethylene and not necessarily to the respective percentages of the whole mixture which is represented by trans-dichloroethylene and perchloroethylene. For instance, a blend of four parts trans-dichloroethylene to one part perchloroethylene will typically impart the same qualities discerned by the tests for the eighty (80%) percent trans-dichloroethylene blends, even if the mixture is "cut" with ten (10%) percent of other commonly used ingredients.

It is noted that the embodiment described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A method of cleaning a surface of a substrate which comprises the step of:

treating said surface with a non-azeotropic solvent mixture comprising trans-1,2-dichloroethylene or cis-1,2-dichloroethylene.

2. The method of claim 1 wherein said treating step further includes the steps of:

immersing the substrate in the solvent mixture;

agitating the solvent mixture around the substrate; and removing the substrate from the solvent mixture.

3. The method of claim 1 wherein said treating step further includes the steps of:

showering the surface of the substrate with the solvent mixture from a collection tank;

draining the solvent mixture into a distillation pot;

distilling the solvent mixture to vaporize the perchloroethylene and the other component;

recondensing the vaporized solvent mixture in a condenser; and rinsing the surface of the substrate with the freshly distilled solvent mixture.

4. The method of claim 1 wherein said treating step further includes the steps of:

brushing the surface of the substrate with the solvent mixture; and allowing the solvent mixture to drip or evaporate from the surface of the substrate.

5. The method of claim 1 wherein said treating step further includes the step of spraying the surface of the substrate with the solvent mixture.

6. A method of cleaning a surface of a substrate which comprises the step of:

treating said surface with a non-azeotropic solvent mixture comprising trans-1,2-dichloroethylene or cis-1,2-dichloroethylene and perchloroethylene.

7. The method of claim 6, wherein said treating step further includes the steps of:

immersing the substrate in the solvent mixture;

agitating the solvent mixture around the substrate; and removing the substrate from the solvent mixture.

8. The method of claim 6, wherein said treating step further includes the steps of:

showering the surface of the substrate with the solvent mixture from a collection tank;

draining the solvent mixture into a distillation pot;

distilling the solvent mixture to vaporize the perchloroethylene and the other component;

recondensing the vaporized solvent mixture in a condenser; and rinsing the surface of the substrate with the freshly distilled solvent mixture.

9. The method of claim 6, wherein said treating step further includes the steps of:

brushing the surface of the substrate with the solvent mixture; and allowing the solvent mixture to drip or evaporate from the surface of the substrate.

10. The method of claim 6, wherein said treating step further includes:

the step of spraying the surface of the substrate with the solvent mixture.

* * * * *